United States Patent [19]

Benoit

[11] 4,437,283

[45] Mar. 20, 1984

[54] SINGLE-PLY ROOFING SYSTEM

[76] Inventor: Louis J. Benoit, 1893 Highland Pkwy., St. Paul, Minn. 55116

[21] Appl. No.: 432,033

[22] Filed: Sep. 30, 1982

Related U.S. Application Data

[63] Continuation-in-part of Ser. No. 358,175, Mar. 15, 1982.

[51] Int. Cl.[3] ..... E04B 5/00

[52] U.S. Cl. ..... 52/410; 52/11; 52/96; 52/411; 428/198

[58] Field of Search ..... 52/410, 408, 411, 416, 52/417, 418, 420, 11, 94, 96, 748; 428/189, 190, 191

[56] References Cited

U.S. PATENT DOCUMENTS

| | | | |
|---|---|---|---|
| 846,572 | 3/1907 | Kunzler | 52/418 |
| 1,578,663 | 3/1926 | Innes | 52/417 |
| 1,599,549 | 9/1926 | Baldwin | 52/416 |
| 2,271,143 | 1/1942 | Martinus | 52/11 |
| 2,974,078 | 3/1961 | Petritz | 52/417 |
| 3,109,207 | 11/1963 | Cooper | 52/417 |
| 4,102,835 | 7/1978 | Freeman | 428/41 |
| 4,223,487 | 9/1980 | St. Clair | 52/11 |
| 4,288,951 | 9/1981 | Carlson | 52/410 |
| 4,335,546 | 6/1982 | Kelly | 52/96 |
| 4,368,604 | 1/1983 | Spielan | 52/411 |
| 4,389,826 | 6/1983 | Kelly | 52/410 |

FOREIGN PATENT DOCUMENTS

| | | | |
|---|---|---|---|
| 644250 | 7/1962 | Canada | 52/417 |

*Primary Examiner*—Henry E. Raduazo
*Attorney, Agent, or Firm*—Wicks & Nemer

[57] ABSTRACT

A single-ply roofing system is disclosed according to the teachings of the present invention as including a roof sheet for covering a roof of the desired construction. In the interior of the roof area, the roof sheet is held to the roof by battens fastened to the roof through the roof sheet. Batten sealing members are provided which will increase bonding strength over a period of time and which may thus be considered to undergo a self vulcanizing-like process with the roof sheet and encapsulate the batten between the roof sheet and the batten sealing member. The roof sheet is held on the roof adjacent the roof edge by edging members having a generally horizontal flange which extends from the roof edge and rests on the top surface of the roof sheet. The edging member is fastened by fasteners which extend through the flange, through the roof sheet, and into the roof. In the preferred embodiments, edging members of the gravel stop edge and gutter installation types are illustrated for explanation of the teachings of the present invention. Flange sealing members are further provided for sealing the flange of the edging members and the flange fasteners with the roof sheet.

12 Claims, 7 Drawing Figures

SINGLE-PLY ROOFING SYSTEM

CROSS REFERENCE

The present application is a continuation-in-part of application Ser. No. 06/358,175 filed on Mar. 15, 1982.

BACKGROUND

This invention relates generally to single-ply roofing systems.

After its introduction, single-ply roofing systems have attracted growing interest and use in the roofing industry. Single-ply roofing systems have many advantages over the well known and used built-up type roof systems. Specifically, built-up roof members were very highly labor intensive in installation and required large capital investment in equipment necessary for installation. Further, built up roof members were very susceptible to the elements. They often split due to expansion and contraction, blister due to moisture penetration between the plies, and rot from standing water on them.

Single-ply roofing systems are easier and faster to install and do not require expensive installation equipment. Further, single-ply roofing systems overcame many of the other problems experienced in built-up roof systems. In single-ply roofing systems, the use of sheets made of ethelene-propelene-diene-monomer (EPDM) has outpaced other material such as sheets of poly vinyl chloride (PVC), neoprene, and poly isobutelene (PIB), and thus EPDM, in general has had greater acceptance by building owners, architects, and roofing contractors. Specifically, EPDM membranes have excellent resistance to ultra-violet rays and will withstand thousands of hours of exposure to sunlight without cracking or deteriorating. Its service temperature range is from −50° F. to 240° F. EPDM membranes have excellent resistance to corrosive chemicals, mineral acids, and vegetable oils. Its extreme elongation factors, high tensile strength, and general compatibility with other materials makes it applicable for most roofing applications both on new construction and reroofing projects. Roofing systems utilizing EPDM membranes are easy for the owner to maintain, modify or even remove and reuse in cases where the building is to be demolished or increased in height.

However, single-ply roofing has had its own problems, some relating to attaching the sheets to the roof surface and to flashings. Prior to the present invention, an adhesive was used, but this has several known shortcomings. First, the adhesive will not keep out water by itself. Therefore, a water seal such as caulk must be placed at all joints where the adhesive is exposed. Second, the adhesive must be allowed to flash off for a period of time depending upon the temperature, a very time consuming procedure. Further, because of its temperature dependence, the adhesive can only be applied during certain seasons and atmospheric conditions. Third, EPDM is often manufactured with talc powder located on both sides. This talc powder as well as any other dirt or residue on the EPDM surface must be hand removed using a solvent, for example, toluene or xylene, and a rag prior to the application of the adhesive to the EPDM sheet. Again, this is very time consuming. Therefore, many extra steps are required in using the adhesive. Fourth, because the adhesive contains solvents which are corrosive to certain types of insulation used on roof decks, elaborate precautions must be taken to avoid contact of adhesive to these types of insulation, for example such as the type set forth in U.S. Pat. No. 4,162,597. Fifth, the adhesive must be hand applied with rollers, brushes or other hand implements to both surfaces to be attached together. This is also very time consuming. Sixth, the adhesive is extremely flammable and explosive. Also, the fumes of the adhesive is a liquid state are harmful to human health. Thus, precautions are necessary when utilizing adhesive for health and safety reasons which are not necessary for a roof system utilizing the teachings of the present invention. Many other disadvantages of the use of adhesive in the prior art are known and will also be obvious once the teachings of the present invention are known.

The present invention then relates to improvements in single-ply roofing systems, of either the ballasted type or unballasted type, such as mechanically fastened or fully adhered, to name just two.

Thus, it is an object of the present invention to provide an improved and novel single-ply roofing system.

It is further an object of the present invention to provide such single-ply roofing system having novel methods for attaching the roof sheet to roof edges which are water resistant.

It is further an object of the present invention to provide such single-ply roofing system having novel methods for attaching the roof sheet to the roof surface.

It is further an object of the present invention to provide such single-ply roofing system having novel methods of attaching the roof sheet to the roof without the use of adhesive.

It is further an object of the present invention to provide such single-ply roofing system utilizing sealing members which will have an increasing bonding strength with the roof sheet over a period of time.

It is further an object of the present invention to provide such single-ply roofing system which is prefabricated off the job site for rapid and simple installation on the job site.

It is further an object of the present invention to provide a novel roofing sealing member.

It is further an object of the present invention to provide such a novel roofing sealing member including added protection against moisture penetration when the sealing members overlap.

These and further objects and advantages of the present invention will become clearer in light of the following detailed description of illustrative embodiments of this invention described in connection with the drawings.

DESCRIPTION OF THE DRAWINGS

The illustrative embodiments may best be described with reference to the accompanying drawings where.

Figure 1:
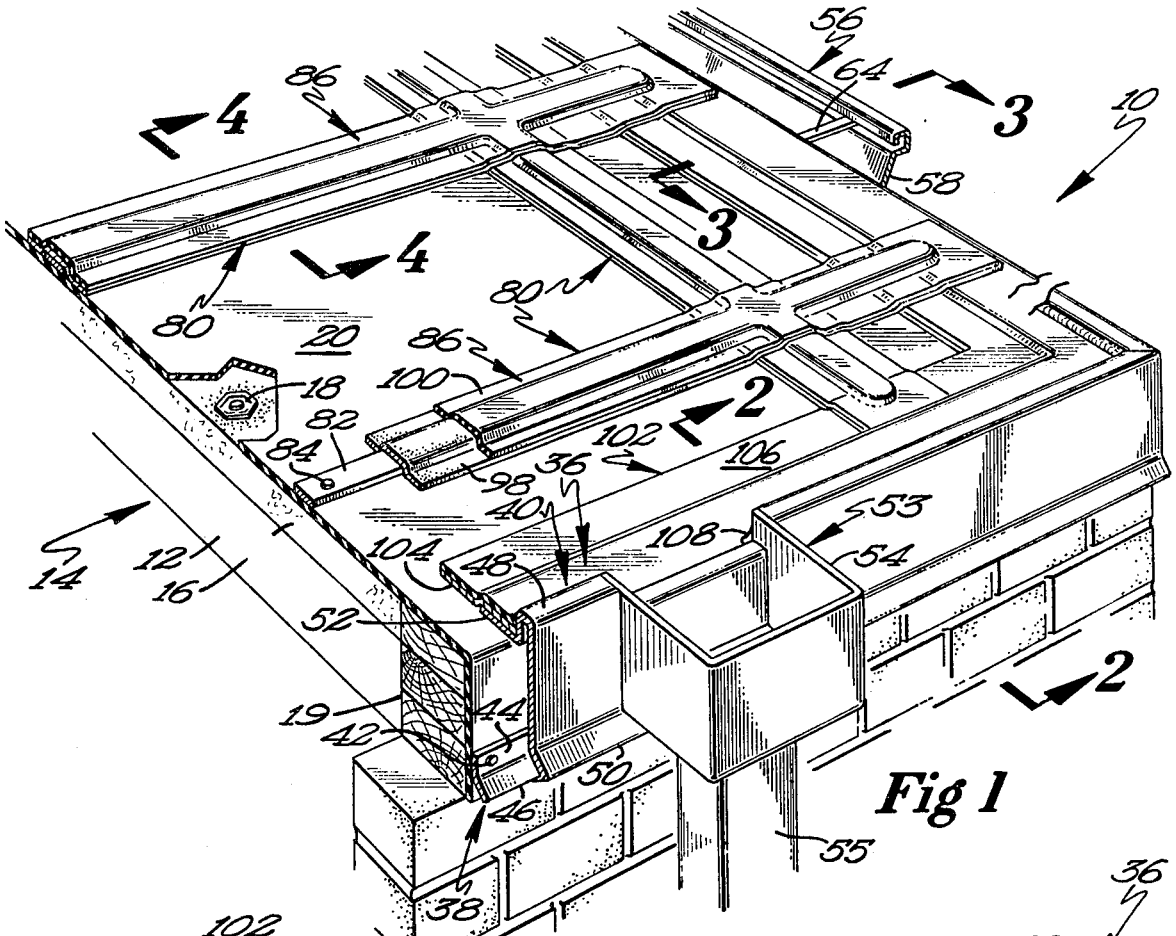
FIG. 1 shows a top view of a single-ply roofing system according to the teachings of the present invention.

All figures are drawn for the ease of explanation of the basic teachings of the present invention only. Extensions of the figures with respect to number, position, relationship, and dimensions of the parts to form preferred embodiments will be explained or will be within the skill of the art after the following teachings of the present invention have been read and understood.

Where used in the various figures of the drawings, the same numerals designate the same or similar parts in the roofing system. Furthermore, when the terms "top", "vertical", "horizontal", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

Referring to the drawings, a single-ply roofing system according to the teachings of the present invention is shown and generally designated 10. System 10 then includes a roof deck 12 of standard construction such as concrete, lightweight concrete, gypsum, a combination metal and concrete or gypsum, wood, or metal. Suitable insulation 16, such as polystyrene, urethane, cellar glass, fiberglas, wood fiber, perlite, isocyanurate, or a composite of perlite and urethane or isocyanurate, or others, can be placed upon roof deck 12. Insulation 16, as is common, may be constructed of blocks of suitable sizes, shapes, and constructions and may be flat or tapered. Wooden curbs 19 may be built up around the perimeter edge of roof deck 12 to a thickness equal to that of insulation 16. Likewise, roof deck 12 can include a parapet wall, not shown, with insulation 16 abutting the parapet wall.

System 10 according to the teachings of the present invention includes members 18 for holding insulation 16 to roof deck 12. For the sake of convenience, roof deck 12, insulation 16, members 18, and curbs 19 are referred to collectively as roof 14. It should be understood that roof 14 can be flat or sloped and can be formed from various constructions and of various materials other than that of roof 14 as illustrated. Roof 14, as illustrated, is shown for convenience in explaining system 10 of the present invention.

Roof sheet 20 is further provided in system 10. Roof sheet 20 is any suitable single-ply roofing membrane, however, in the preferred embodiment is an EPDM membrane and is described as being manufactured without the use of talc, for example, as manufactured by Mitsuboshi Belting Ltd. or by Toyo Rubber Industry Co., Ltd., both of Japan.

System 10 further includes members 80 for securing sheet 20 in the interior area of roof 14. Members 80 generally include battens 82 which are secured to roof 14 by suitable fasteners 84, such as self-drilling, self-tapping steel fasteners, and include composite sealing member 86. In the preferred embodiment, battens 82 have an elongated length and a width and are formed of metal. However, battens 82 can be formed of various material having the parameters necessary to secure sheet 20 to roof 14 according to the teachings of the present invention. Sealing member 86 is multi-layered and, in the preferred embodiment, includes a double-faced tape 98 and a cover member 100. In the preferred embodiment, cover member 100 is formed of the same material as sheets 20, and specifically is formed from an EPDM membrane manufactured without the use of talc. It is further required that cover member 100 withstand at least 60 psi pressure when subjected to Factory Mutual Laboratory standard wind uplift tests.

Tape 98 must be able to adhere to both roof sheet 20 and cover member 100 and, in the preferred embodiment, will increase bonding strength over a period of time and which may thus be considered to undergo a self vulcanizing-like process with sheet 20 and cover member 100. Furthermore, tape 98 must be sufficiently flexible to allow its application over irregular shapes. Tape 98 must also be able to withstand the expansion and contraction of roof 14 and roof sheet 20 as well as withstand other roof environmental conditions such as extreme heat or cold without failure, such as separation from sheet 20 or cover member 100. In the preferred embodiment, tape sold under the trademark "NEO-SEAL TAPE", "NEOJOINT TAPE" sold by Mitsuboshi Belting, Ltd. of Japan and tape sold under the trademark "BATTENFAST" by Benoit, Inc. of St. Paul, Minn. and Toyo Rubber Industries Co., Ltd. of Japan have been found to satisfy the requirements of tape 98 according to the teachings of the present invention.

In installation, after sheet 20 has been placed upon roof 14, battens 82 are placed in the desired described positions upon the top surface of sheet 20. At that time, battens 82 are fastened to roof 14 by fasteners 84 which extend through battens 82 and into roof 14.

Figure 4:
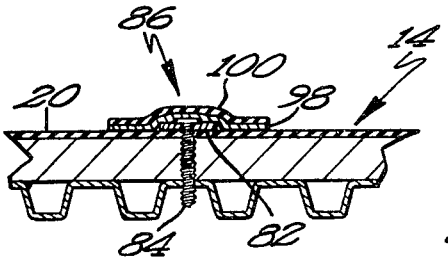
FIG. 4 shows a partial sectional view of the roofing system of FIG. 1 according to section line 4—4 of FIG. 1.

It can then be appreciated that fasteners 84 puncture sheet 20 and thus can allow moisture and other natural elements to get into roof 14, which is highly undesireable. Thus, as best seen in FIGS. 1 and 4, sealing members 86 are provided to prevent moisture and other elements from communicating with the apertures formed by fasteners 84 and getting into roof 14.

Figure 5:
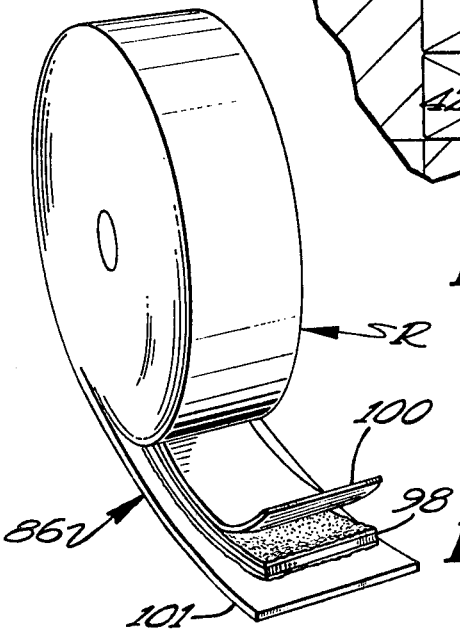
FIG. 5 shows a perspective view of a sealing member roll for use in a roofing system according to the teachings of the present invention.

In the preferred embodiment, members 86 are four inches wide and retailed in 50 feet rolls R having a liner 101 attached to the exposed surface of tape 98 as best seen in FIG. 5. In the preferred embodiment, liner 101 has a width greater than the width of sealing member 86 for ease of separation from sealing member 86 and to insure that the entire exposed adhesive surface of tape 98 of member 86 is covered. After member 86 is cut from supply roll R at its desired length, liner 101 can be partially removed starting at one end of member 86. The exposed surface of tape 98 can then be straddled over batten 82 and on sheet 20. Thereafter, simultaneously as liner 101 is removed from tape 98, member 86 can be positioned on sheet 20 straddling batten 82. After member 86 is fully positioned, pressure may be applied to the top surface of cover member 100 of member 86 to insure adhesion between tape 98 and sheet 20, as by a hand roller.

It should then be noted that in the preferred embodiment, tape 98 is desired to increase bonding strength over a period of time in use and thus may be considered to undergo a self vulcanizing-like process with sheet 20 and cover member 100 such that cover member 100 and sheet 20 form a unitary member which encapsulates battens 82 and fasteners 84. Thus, after positioning, battens 82, fasteners 84, and also the apertures formed in sheet 20 by fasteners 84 are sealed from moisture and the elements by member 86 in conjunction with sheet 20.

It can then be appreciated that members 86 of the present invention provide effective sealing of the apertures formed in sheet 20 by fasteners 84 and do not require any other material such as caulking at the edges of sealing members 86.

It should also be appreciated that, in the preferred embodiment, when member 100 is formed of the same material as sheet 20, members 86 can overlap each other at junctions, as shown in FIG. 1. In an overlapping situation, tape 98 of the top member 86 undergoes this vulcanizing-like process with cover member 100 of the bottom member 86. Thus, due to this vulcanization-like process, the intersecting members 86 will be effectively sealed with each other as well as with sheet 20. For added protection against moisture penetration, a seam sealer can be applied at the covered edges of the bottom member 86 over which the top member 86 intersects to insure sealing therebetween.

Prior to the present invention, after battens 82 were installed utilizing fasteners 84, a six inch strip of material was cut from suitable material, such as a strip of 60 mil thick uncured EPDM or neoprene. This strip was laid next to batten 82. The top surface of sheet 20 adjacent batten 82 was cleaned utilizing toluene or xylene. Liquid adhesive was then hand applied to both surfaces and allowed to flash off. The strip was then placed on the roof sheet and hand rolled to assure that all the air bubbles were rolled out. All of the seams were then seam sealed such as with caulk.

Now that the installation of roof sheet 20 utilizing members 86 according to the teachings of the present invention has been explained, some of the subtleties and advantages of the present invention over prior single-ply roofing systems can be understood.

First, utilizing the present invention, substantial savings of time and labor can be realized because several steps of installation of the prior art can be eliminated and because the installation of the present invention does not require the piecemeal installation of the prior art. Furthermore, since member 86 can be manufactured and sold as a composite unit off the job site, member 86 can be more efficiently manufactured utilizing machinery rather than the high labor intensive fabrication which would be required if member 86 were fabricated at the job site as before the present invention.

Second, the cleaning of sheets 20 and other attachment surface with toluene or xylene is not required or greatly reduced utilizing tape 98 of member 86 on EPDM manufactured without talc rather than adhesive as in the prior art.

Third, members 86 can be easily and quickly applied in one application rather than the hand brushing to both adhering surfaces required with liquid adhesive and other fabrication steps. In fact, as set forth hereinbefore, members 86 can be prefabricated at the factory rather than fabricated in the field, and thus as many as three construction steps can be eliminated in the field.

Fourth, tape 98 of member 86 does not require flashing off as was required by liquid adhesives. This has several advantages. Specifically, no waiting is required for flashing off and thus, members 86 offer labor savings. Further, tape 98 of members 86 is not as environmentally dependent as liquid adhesive and thus members 86 can be applied in more varied environmental conditions. For example, it is recommended that liquid adhesives not be applied when temperatures are below 40° F. whereas tape 98 of member 86 can be utilized in colder environmental conditions.

Fifth, a stronger bond is obtained utilizing tape 98 of member 86 rather than liquid adhesive as in the prior art. Thus, tape 98 of member 86 has greater holding power. In fact, the seams between sheet 20 and member 100 adhered by tape 98 have been found to have a lap strength in excess of the tensile strength of sheets 20, thus creating a seam which is stronger than sheet 20 itself.

Also, seam sealers are not required as set forth hereinbefore. Additionally, tape 98 does not require the application of heat or the use of sonic, electromagnetic or heat waves to cause adhesion. Furthermore, tape 98 is safer to use for health, fire and explosion reasons than adhesive.

Of course, the above listing is a sampling of advantages of the present invention over prior roof systems and other advantages will be obvious and evident once the teachings of the present invention are read, understood, and used by persons skilled in the art.

Roof sheet 20 may also be attached to the roof edges and similar applications utilizing the teachings of the present invention, as was set forth above and will now be set forth hereinafter, utilizing the preferred embodiments described in the present application. Although only a few examples are set forth, after the teachings of the present invention are read and understood, these teachings can be expanded to other specific applications of roofing system 10 and other roofing systems.

Figure 2:
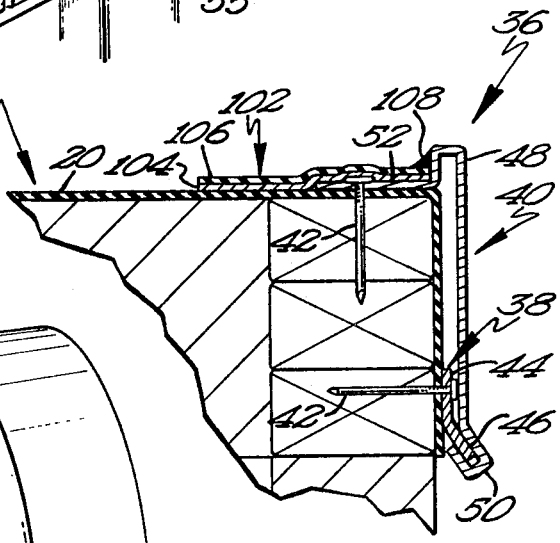
FIG. 2 shows a partial cross sectional view of the roofing system of FIG. 1 according to section line 2—2 of FIG. 1.

A first example is set forth in FIG. 2 showing the attachment of roof sheet 20 to a gravel stop edge 36. Specifically, as shown in FIG. 2, gravel stop edge 36 includes a continuous hook or keeper strip 38, a gravel stop 40, and approved fasteners 42. Strip 38 includes a generally elongated flat portion 44 having an outstanding lip 46. Stop 40 includes a generally vertical member 48 having a hooked portion 50 located on the bottom portion thereof for engaging with lip 46 of strip 38 and includes a flange 52 which extends generally horizontally from member 48, just vertically below the top edge of member 48. Thus, the portion of member 48 which extends above flange 52 acts as a stop or abutting member for preventing water from flowing over the edge rather than down a down spout or roof drain. In the case of ballasted sheet 20, the top edge of member 48 also prevents gravel or other ballast located on sheet 20 from being pushed off the roof edge.

As shown in FIG. 1, stop edge 36 can further include a down spout member or scupper 53 for allowing water to drain from roof 14. Member 53 includes a rectangular portion or spill box 54 attached to vertical member 48 and having a height equal to member 48. A removed portion is formed along the common side of member 53 and member 48 having a height equal to the height of flange 52 to allow water to run from roof 14 and into rectangular portion 54. The bottom of rectangular portion 54 terminates in and forms a drain spout 55.

In this first example, after insulation 16 has been installed, after hold down members 18 have been installed, and after sheet 20 is applied, strip 38 is attached to the outside vertical edge of curb 19 by fasteners 42 which extend through flat portion 44 of strip 38, and through sheet 20 which extends into the vertical side of curb 19. Stop 40 can then be positioned such that hooked portion 50 engages or hooks with lip 46 of strip 38. Fasteners 42 can then be positioned through flange 52 of stop 40, through sheet 20 and into the horizontal top of curb 19.

It can then be appreciated that fasteners 42 which extend through flat portion 44 of strip 38 are effectively protected and covered from the elements by vertical member 48 of stop 40. Thus, no further sealing is required for these fasteners 42. However, fasteners 42 which extend through flange 52 of stop 40 require sealing. Specifically, apertures formed by fasteners 42 extending through flange 52 and sheet 20 may allow moisture and other natural element communication into roof 14, which is very detrimental to roof 14 and thus highly undesireable. According to the teachings of the present invention, composite sealing members 102 are provided to prevent this moisture and element communication.

Sealing members 102 are similar to members 86, but are distinctive therefrom. Members 102 are also multilayered and, in the preferred embodiment, includes a doublefaced tape 104 and a cover member 106. In the preferred embodiment, cover member 106 is formed of the same material as sheets 20, and specifically in this preferred embodiment is formed from an EPDM membrane manufactured without the use of talc.

Tape 104 in the preferred embodiment is of the nonvulcanizing type and must be able to adhere to both roof sheet 20 and metallic members such as gravel stop 36. Furthermore, tape 104 must be sufficiently flexible to allow its application over irregular shapes. Tape 104 must also be able to withstand the expansion and contraction of roof 14 and roof sheet 20 as well as withstand other roof environmental conditions such as extreme heat or cold without failure, such as separation from sheet 20, cover member 106, or the metallic member such as gravel stop 36. In the preferred embodiment, a tape 104 found to function is a butyl tape, and more particularly, 3M Adhesive Sealer 5354 manufactured and sold by Minnesota Mining and Manufacturing Company, St. Paul, Minn. It has been found that if a vulcanizing-like tape such as tape 98 is utilized with sealing members 102 that sealing members 102 will pull away from metallic members and thus break any seal therewith. Therefore, sealing members 102 utilize nonvulcanizing tape 104 in the preferred embodiment rather than tape of a vulcanizing-like type.

In a similar manner as members 86, members 102 are retained in 50 foot rolls but are six inches wide. A paper backer is provided to cover the exposed side of tape 104 which is not attached to member 106. In this preferred form, member 102 can be quickly installed in a single step at a great savings of field time and labor. Specifically, member 102 can be applied in a similar manner as set forth with respect to member 86. However, to insure that a moisture and element seal is maintained between the seam edge and metal flange 52 of stop 36, the seam can be sealed by a seam seal 108 such as with caulk. Utilizing member 102 according to the teachings of the present invention, a seam sealer is not required for the seam edge between member 102 and sheet 20.

Prior to the present invention, after stop 36 was installed in an analogous manner as in the present invention, a flashing was placed over flange 52 and sheet 20. Specifically, it was necessary to clean the top side of flange 52 and the portion of sheet 20 upon which the flashing would be connected with toluene or xylene. After cleaning, adhesive was then applied over 100 percent of the cleaned surfaces on flange 52 and sheet 20 and the flashing and allowed to flash off before adhering the two surfaces together. After the flashing was in place, it was then necessary to seal both edges of the flashing with a seam sealer such as caulking.

It can now be recognized that this aspect of the present invention has many advantages over the prior art. First, the use of tape 104 of member 102 rather than liquid adhesive as in prior systems has several advantages as explained further hereinbefore and hereinafter.

Second, in a similar manner as set forth for members 86, utilizing the present invention, substantial savings of time and labor can be realized because several steps of installation of the prior art can be eliminated and because the installation of the present invention does not require the piecemeal installation of the prior art. Furthermore, since member 102 may be manufactured and retailed as a composite unit off the job site, member 102 can be more efficiently manufactured utilizing machinery rather than the high labor intensive fabrication which would be required if member 102 were fabricated at the job site.

Third, the cleaning of sheets 20 and other attachment surfaces with toluene or xylene is not required or greatly reduced utilizing tape 104 of member 102 and EPDM manufactured without talc rather than adhesive as in the prior art.

Fourth, members 102 can be easily and quickly applied rather than the hand brushing to both adhering surfaces required with liquid adhesive and other fabrication steps. In fact, as set forth hereinbefore, members 102 can be prefabricated at the factory rather than fabricated in the field, and thus as many as three constructions steps can be eliminated in the field.

Fifth, tape 104 of member 102 does not require flashing off as was required by liquid adhesives. This has several advantages. Specifically, no waiting is required for flashing off and thus, members 102 offer labor savings. Further, tape 104 of member 102 is not as environmentally dependent as liquid adhesive and thus members 102 can be applied in more varied environmental conditions. For example, it is recommended that liquid adhesives not be applied when temperatures are below 40° F. whereas tape 104 of member 102 can be utilized in colder environmental conditions.

Sixth, a stronger bond is obtained utilizing tape 104 of member 102 rather than liquid adhesive as in the prior art. Thus, tape 104 of member 102 has greater holding power.

Lastly, the present invention does not require the additional seam sealing of the seam edge between sheet 20 and the sealing member 102 as was required with the prior art. Furthermore, member 102 utilizing tape 104 is safer to use for health, fire, and explosion reasons than prior sealing members utilizing adhesive. Of course, the above listing is a sampling of advantages of the present invention over prior roof systems and other advantages will be obvious and evident once the teachings of the present invention are read, understood, and used by persons skilled in the art.

Figure 3:
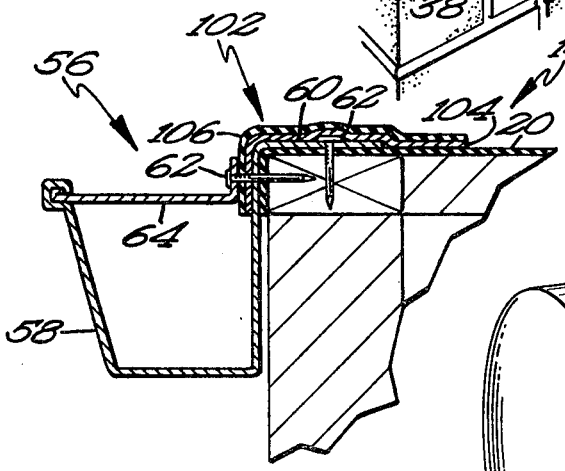
FIG. 3 shows a partial sectional view of the roofing system of FIG. 1 according to section line 3—3 of FIG. 1.

In like manner, gutter installation 56 is shown in FIG. 3. Specifically, gutter installation 56 includes a trough member 58 having a flange 60 which extends onto the roof from the back edge thereof in a horizontal manner. In attaching gutter installation 56, after sheet 20 is located on roof 14, flange 60 is positioned over the top surface of curb 19 and trough member 58 can be located adjacent to the exterior vertical surface of curb 19. Approved fasteners 62 can then be positioned to extend through flange 60, through sheet 20, and into curb 19 for attaching gutter installation 56 to curb 19 and thus to roof 14.

It can then be appreciated that fasteners 62 which extend through sheet 20 and flange 60 require sealing. Specifically, apertures formed by fasteners 62 extending through sheet 20 and flange 60 may allow moisture and other natural element communication to roof 14 which is detrimental to roof 14 and thus undesirable. According to the teachings of the present invention, sealing members 102 are provided to prevent this moisture and element communication. Specifically, member 102 can be attached to extend vertically into trough member 58, over flange 60, and onto sheet 20 in a similar manner as member 102 was described in connection with its attachment to gravel stop 36. It should be noted that since the seam between member 58 and member 102 is directed vertically downward, it is not prone to moisture and element introduction or separation and thus does not require seam sealing. Utilizing members 102 of the present invention, seam sealer is not required for the seam between sheet 20 and member 102.

If desired, suitable gutter hangers 64 can be provided at spaced locations having their first ends secured to the outer edge of trough member 58 and their second ends secured to the roof deck, for example, by fasteners 62 which extend through hanger 64, member 102, sheet 20, and into curb 19.

Prior to the present invention, after gutter installation 56 was installed in an analogous manner as in the present invention, a flashing adhesively attached and having its seams sealed was then provided in an analogous manner as that previously set forth with respect to the prior art gravel stop ege 36. Hangers 64, if desired, were then installed in an analogous manner to that set forth with respect to the present invention.

It can now be recognized that the gutter installation according to the teachings of the present invention has the same or similar advantages over prior art gutter installations as set forth with respect to the gravel stop edge hereinbefore.

As seen in FIG. 1, members 80 and the flanges of the desired edging member and sealing member 102 intersect and overlap at the roof perimeter. Thus, roof sheet 20 is very securely attached at the roof perimeter to prevent uplift such as by wind and other roof perimeter damage. For added protection against moisture penetration, a seam sealer can be applied at the covered edges of the bottom roof sheet securement method over which the top roof sheet securement method intersects to insure sealing therebetween. However, it can be appreciated that in this overlapping situation, due to adhesion and bond strength of tape 98 and 104, an effective seal against moisture and natural element communication may be obtained without seam sealing. Further, it should be noted that tape 98 of member 86 will also undergo the vulcanizing-like process with member 106 of sealing member 102 in such an intersecting and overlapping situation.

It should be noted that for purposes of illustration, the thickness of members 100 and 106, tape 98 and 104, sheet 20, roof 14, and other roof edge systems has been exaggerated.

Figure 6:
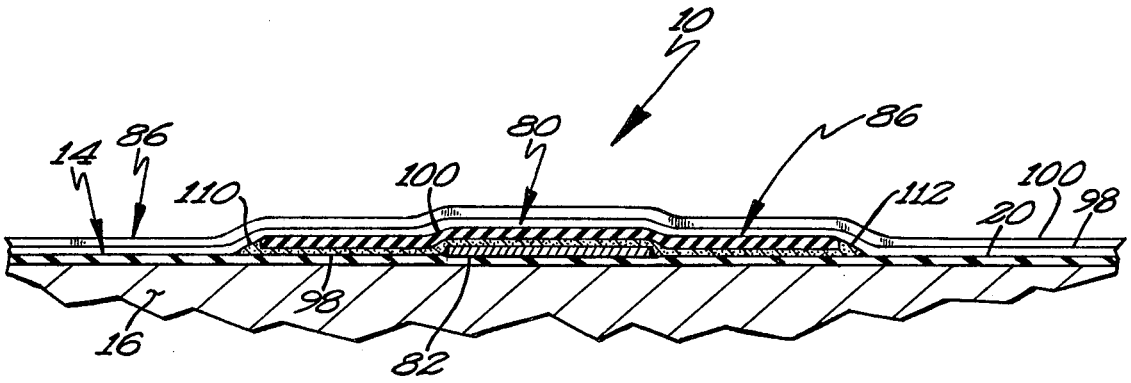
FIG. 6 shows a partial sectional view of an alternate roofing system according to the teachings of the present invention.
Figure 7:
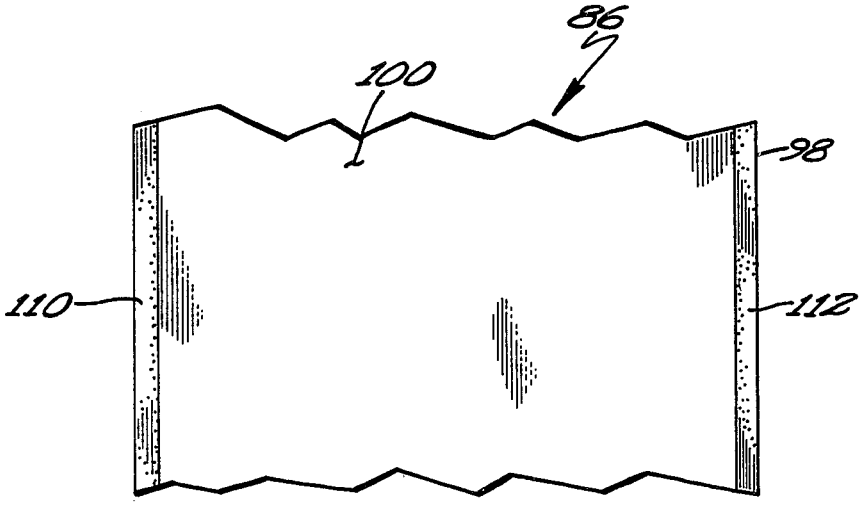
FIG. 7 shows a top view of a portion of the roofing system sealing member of FIG. 6.

After using the basic teachings of the present invention, a further improved, alternate novel method and apparatus was discovered for added protection against moisture penetration when members 86 overlap as best seen in FIGS. 1 and 6. Specifically, as best seen in FIGS. 6 and 7, in the improved, alternate embodiment, tape 98 has a width which is wider than member 100 such that the edges of member 100 are both spaced laterally inwardly from the edges of tape 98. Specifically, a first sealing edge 110 is formed by the portion of tape 98 which extends beyond the first edge of member 100 and having a lateral width equal to the spacing between the first edges of tape 98 and member 100. In a similar manner, a second sealing edge 112 is formed by the portion of tape 98 which extends beyond the second edge of member 100 and having a lateral width equal to the spacing between the second edges of tape 98 and member 100.

Thus, when members 86 overlap or intersect, sealing edges 110 and 112 formed by the exposed tape 98 of the bottom composite roofing system sealing member 86 shown as the first member 86 in FIG. 6 which extends beyond the edges of member 100 adheres to tape 98 of the top composite roofing system sealing member 86 shown as the second member in FIG. 6. In addition, tape 98 of the second, top member 86 adheres to member 100 of the first, bottom member 86. Sealing edges 110 and 112 formed by the exposed tape 98 of the first, bottom member 86 which extend beyond the edges of member 100 acts like seam sealers or caulk for filling the trough which would be otherwise created due to the thickness of member 100 at the intersection of members 86. In other words, sealing edges 110 and 112 act as wedge members to fill the troughs and extend from the top surface of sheet 20 generally to the top surface of member 100 of the bottom member 86. If desired, the edges of the tape 98 and thus sealing edges 110 and 112 can be angled as shown in FIGS. 6 and 7 to enhance this wedge-like effect. It should be appreciated that pressure should be applied to the top member 86 to assure adherence of sealing edges 110 and 112 of the bottom member 86 to tape 98 of the top member 86 such as by depressing with the applicator's thumb or a one quarter inch wide stitch roller.

In its most preferred form, the width of tape 98 is in the range of one quarter inch greater than the width of member 100 such that the edges of member 100 are located generally one eighth inch laterally inward of the edges of tape 98 or in other words the lateral width of sealing edges 110 and 112 is generally one eighth inch.

Now that the basic teachings of the present invention have been explained, many extensions and variations will be obvious to one having ordinary skill in the art. For example, the roof edge systems 36 and 56 or members 80 and 102 of the present invention can be utilized in a roofing system together or separately with prior art roof system components. However, a total roofing system utilizing the present invention is preferred.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Roofing system sealing member for use in a roofing system having a roof covering sheet formed of a material and having a length and a width, comprising, in combination: a covering member formed from a material, with the material being sufficiently flexible to allow its application over irregular shapes and being able to withstand the expansion and contraction of the roof, with the covering member having a longitudinal length dimension and a first edge and a second edge defining a lateral width dimension therebetween, with the lateral width dimension being substantially less than the width of the roof covering sheet; a tape having sufficient flexibility to allow its application over irregular shapes and able to withstand the expansion and contraction of the roof and the roof sheet, with the tape having a longitudinal length dimension and a first edge and a second edge defining a lateral width dimension therebetween, with the width of the tape being larger than the width of the covering member and being substantially less than the width of the roof covering sheet, and with the tape having a first surface adhered to the covering member with the first edge of the covering member being located laterally inwardly of the first edge of the tape forming a first sealing edge and with the second edge of the covering member being located laterally inwardly of the second edge of the tape forming a second sealing edge, and with the tape having a second, exposed surface for adherence to the roof sheet; with the tape being fabricated with the covering member as a composite unit off the job site allowing its efficient manufacture and installation; wherein when a first composite roofing system sealing member intersects with a second composite roofing system sealing member to form troughs, the first and second sealing edges formed by the tape which extend beyond the covering member and the covering member of the first sealing member adhere to the roof sheet adhering surface of the tape of the second sealing member to act as seam sealers in the troughs created at the intersection of the roofing system sealing members.

2. The sealing member of claim 1 wherein the width of the tape is in the range of one quarter inch wider than the width of the covering member, with the edges of the tape extending generally one eighth inch beyond the edges of the covering member.

3. The sealing member of claim 1 wherein the tape is of the non-vulcanizing type which does not vulcanize with the covering member or the roof sheet but is able to adhere to the covering member, the roof sheet, and metal.

4. The sealing member of claim 1 wherein the tape is of the vulcanizing type which vulcanizes with the roof covering sheet and the covering member.

5. The sealing member of claim 1 wherein the covering member is formed of ethelene-propelene-dienemonomer (EPDM).

6. The sealing member of claim 5 wherein the EPDM is manufactured without the use of talc powder.

7. The sealing member of claim 1 further comprising, in combination: a removable liner member for covering the second, roof sheet adhering surface of the tape.

8. The sealing member of claim 1 in combination with a roofing system, wherein the roofing system includes members for holding the roof covering sheet onto the roof, with the holding members having an elongated length and a width; and means extending through the roof sheet for fastening the holding member to the roof, with the width of the covering member being greater than the width of the holding member, with the composite roofing system sealing member being placed to extend at least beyond one edge of the holding member and onto the roof sheet.

9. The sealing member of claim 8 wherein the holding members are battens for holding the roof covering sheet onto the interior area of the roof, wherein the tape increases its bonding strength with the covering member and the roof covering sheet over a period of time in use in a vulcanizing-like process, and with the roofing system sealing member being placed to straddle the batten and together with the roof sheet encapsulate the battens after the tape adheres with the covering member and the roof covering sheet.

10. The sealing member of claim 8 further comprising a metallic roof edging member for placement along the roof edge, with the holding member extending generally horizontally from the metallic roof edging member to form a flange, with the tape being of the non-vulcanizing type, and with the roofing system sealing member being placed to cover the flange and extend onto the roof covering sheet.

11. The sealing member of claim 10 wherein the edging member comprises a gravel stop edge comprising, in combination: a keeper strip including a generally elongated flat portion and an outstanding lip; a generally vertical member having a top edge and a bottom edge, a hooked portion formed on the bottom edge of the generally vertical member for engaging with the lip of the keeper strip, and with the flange extending generally horizontally from the generally vertical member vertically below the top edge of the vertical member.

12. The sealing member of claim 10 wherein the roof edging member comprises: a gutter installation including a trough member, with the flange of the edging member being attached to the trough member.

* * * * *